US010658802B2

(12) United States Patent
Schreiber et al.

(10) Patent No.: US 10,658,802 B2
(45) Date of Patent: May 19, 2020

(54) GRAVITY PLUG AND CONNECTOR

(71) Applicant: GYRUS ACMI, INC., Southborough, MA (US)

(72) Inventors: Friedemann Schreiber, Hamburg (DE); Mario Arnold, Teltow (DE); Daniel Thomas, St. Mellons (GB); Kester J. Batchelor, Mound, MN (US)

(73) Assignees: Gyrus Acmi, Inc., Southborough, MA (US); Olympus Winter & Ibe Gmbh, Hamburg (DE); Gyrus Medical Limited, St Mellons Cardiff (GB)

( * ) Notice: Subject to any disclaimer, the term of this patent is extended or adjusted under 35 U.S.C. 154(b) by 0 days.

(21) Appl. No.: 15/610,905

(22) Filed: Jun. 1, 2017

(65) Prior Publication Data

US 2017/0373447 A1 Dec. 28, 2017

Related U.S. Application Data

(60) Provisional application No. 62/354,172, filed on Jun. 24, 2016.

(51) Int. Cl.
*H01R 13/631* (2006.01)
*H01R 24/28* (2011.01)
(Continued)

(52) U.S. Cl.
CPC ..... *H01R 24/28* (2013.01); *H01R 13/631* (2013.01); *H01R 13/64* (2013.01); *H01R 24/20* (2013.01);
(Continued)

(58) Field of Classification Search
CPC ..... H01R 13/6397; H01R 13/6275; H01R 13/62933; H01R 13/6272; H01R 13/642; H01R 2103/00; B60L 11/1818
(Continued)

(56) References Cited

U.S. PATENT DOCUMENTS 3,950,052 A 4/1976 Walter et al.
4,003,616 A 1/1977 Springer
(Continued)

FOREIGN PATENT DOCUMENTS

CN 202068024 U 12/2011
CN 102570170 A 6/2012
(Continued)

OTHER PUBLICATIONS

European Search Report from the European Patent Office for Application No. EP 17174640 dated Nov. 7, 2017.
(Continued)

*Primary Examiner* — Hien D Vu
(74) *Attorney, Agent, or Firm* — Schwegman Lundberg & Woessner, P.A.

(57) ABSTRACT

A plug comprising: a plurality of pins or a plurality of sockets; a body portion housing the plurality of pins or the plurality of sockets and the body portion extending parallel to a longitudinal axis of the plurality of pins or the plurality of sockets; a connection section connected to the body portion and extending from the body portion at an obtuse angle; and a cord connected to an end of the connection section; wherein the body portion and the connection section are connected at a joint and the joint includes a sub-flush radius on an underside of the joint.

19 Claims, 7 Drawing Sheets

(51) Int. Cl.

| | |
|---|---|
| ***H01R 24/20*** | (2011.01) |
| ***H01R 13/64*** | (2006.01) |
| *H01R 13/633* | (2006.01) |
| *H01R 107/00* | (2006.01) |

(52) U.S. Cl.
CPC ..... *H01R 13/6335* (2013.01); *H01R 2107/00* (2013.01); *H01R 2201/12* (2013.01)

(58) Field of Classification Search
USPC ..... 439/403, 310, 604, 352, 677
See application file for complete search history.

(56) References Cited

U.S. PATENT DOCUMENTS

| | | | | |
|---|---|---|---|---|
| 4,284,312 | A * | 8/1981 | Patchett | H01R 13/5219 439/281 |
| 4,420,209 | A * | 12/1983 | Reis | H01R 13/6271 439/357 |
| 4,707,045 | A * | 11/1987 | Ney | H01R 13/5221 439/252 |
| 5,567,181 | A | 10/1996 | Lentz et al. | |
| 5,639,256 | A * | 6/1997 | Endo | B60L 11/1818 439/353 |
| 8,317,534 | B2 * | 11/2012 | Osawa | H01R 13/6275 439/353 |
| 8,376,767 | B2 * | 2/2013 | Kahara | B60K 15/03 439/304 |
| 8,568,155 | B2 * | 10/2013 | Sebald | H01R 13/5227 439/304 |
| 9,763,942 | B2 | 9/2017 | Natter et al. | |
| 9,793,642 | B2 * | 10/2017 | Natter | H01R 13/506 |
| 2006/0094285 | A1 | 5/2006 | Newell | |
| 2012/0164871 | A1 | 6/2012 | Teichmann | |
| 2013/0052853 | A1 | 2/2013 | Natter et al. | |
| 2015/0303737 | A1 | 10/2015 | Steinbuchel, IV et al. | |

FOREIGN PATENT DOCUMENTS

| | | | |
|---|---|---|---|
| CN | 102570170 | A | 7/2012 |
| CN | 101867122 | B | 10/2012 |
| CN | 202662891 | U | 1/2013 |
| CN | 102957028 | A | 2/2013 |
| CN | 102957028 | A | 3/2013 |
| CN | 203250926 | U | 10/2013 |
| CN | 203312567 | U | 11/2013 |
| DE | 19509336 | A1 | 9/1995 |
| EP | 2469664 | A1 | 6/2012 |
| EP | 3261194 | | 12/2017 |
| JP | H06-38174 | U | 5/1994 |
| JP | 2014-160611 | A | 9/2014 |

OTHER PUBLICATIONS

56PA Australia Angled Plugs, available at http://www.alibaba.com/product-detail/56PA-Australia-Angled-plugs_671348986.html, last accessed Jun. 22, 2016.

AeroVironment TurboCord, available at http://store.evsolutions.com/turbocord-240v-ul-listed-p51.aspx?utm_medium=cse&utm_source=googlebase&gclid=C16Mzf-KvM0CFQqKaQodlgElQg, last accessed Jun. 22, 2016.

Potentially related co-pending Design U.S. Appl. No. 29/600,264, filed Apr. 11, 2017.

Japanese Office Action from the Japanese Patent Office for Application No. 2017-122137 dated Sep. 19, 2018.

Chinese Office Action from the China National Intellectual Property Administration for Application No. 201710478885.X dated Nov. 9, 2018.

Chinese Office Action for Application No. 201710478885.X dated Sep. 2, 2019.

Chinese Office Action for Application No. 201710478885.X dated May 13, 2019.

"European Application Serial No. 17174640.7, Extended European Search Report dated Nov. 10, 2017", 8 pgs.

* cited by examiner

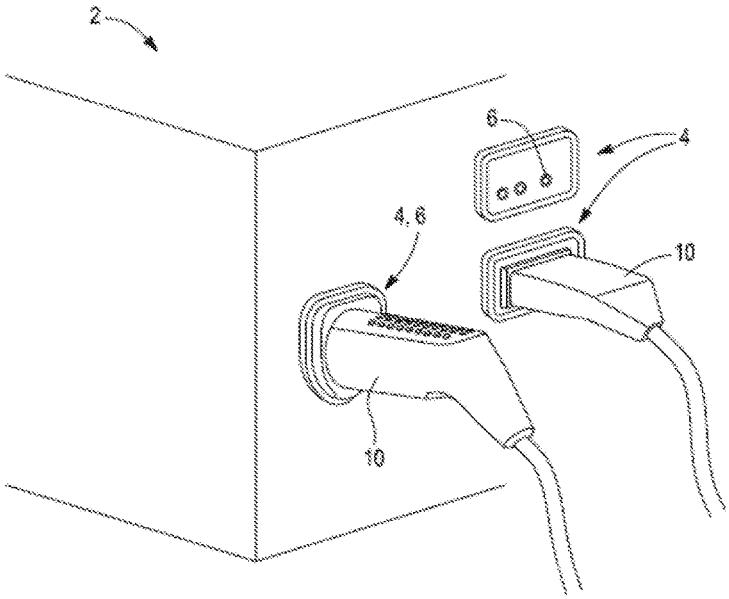
Fig-1
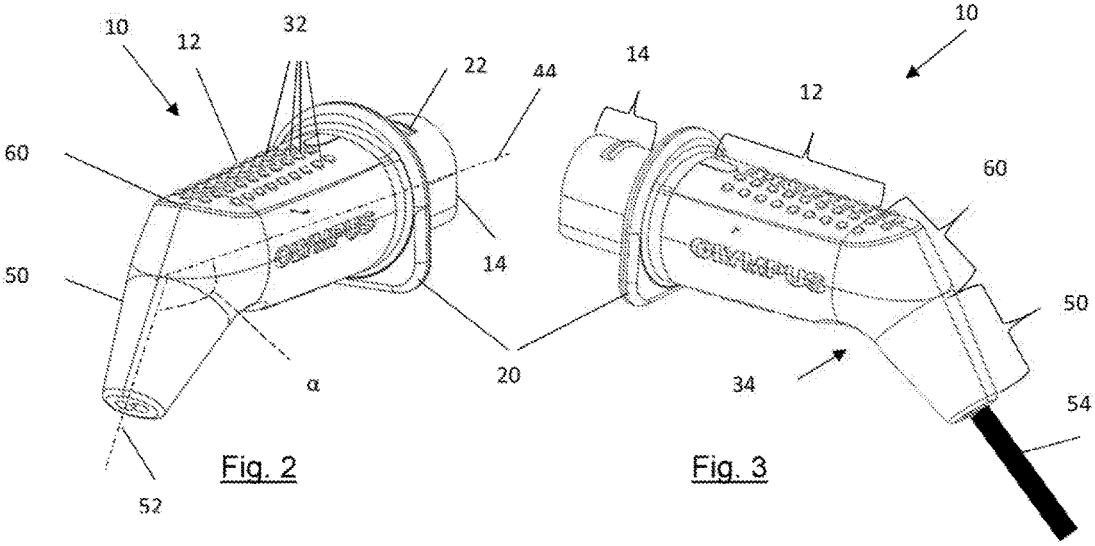
Fig. 2
Fig. 3

GRAVITY PLUG AND CONNECTOR

FIELD

The present teachings generally relate to plugs and receptacles, and more specifically to plugs and receptacles for generators that are complementary to each other, and facilitate a proper connection.

BACKGROUND

Typically, generators include one or more receptacles so that a plug can be inserted into the receptacle and a device connected to the plug is provided with power or signals so that the device is controlled or powered through the generator. Typically, the plug includes male pins that extend into the receptacle of the generator to form an electrical and/or signal connection. Some of these pins may be small and may be subject to deformation if the plug is not inserted into the receptacle of the generator properly. Other plugs may have look substantially identical all of the way around the plug such that it may be difficult for a user to orient the pug and the receptacle so that a proper connection is formed on a first attempt.

Examples of some plugs may be found in U.S. Pat. Nos. 3,950,052; 4,003,616; 5,567,181; and U.S. Patent Application Publication Nos. 2006/0094285 and 2015/0303737 and 56PA Australia Angled Plugs available at http://www.alibaba.com/product-detail/56PA-Australia-Angled-plugs 671348986.html last accessed Jun. 22, 2016 all of which are incorporated by reference herein for all purposes. It would be attractive to have a plug with a body portion and a connection section that extend at an obtuse angle relative to each other. It would be attractive to have a joint section that connects a body portion and a connection section together and the joint section includes a sub-flush radius. What is needed is a joint section that connects a body portion and a connection section together and the joint section includes a thumb ridge. What is needed is a plug with a boss that has a D-shaped outer bore. What is needed is a plug with a hilt that is D-shaped.

SUMMARY

The present teachings meet one or more of the present needs by providing: a plug comprising: a plurality of pins or a plurality of sockets; a body portion housing the plurality of pins or the plurality of sockets and the body portion extending parallel to a longitudinal axis of the plurality of pins or the plurality of sockets; a connection section connected to the body portion and extending from the body portion at an obtuse angle; and a cord connected to an end of the connection section; wherein the body portion and the connection section are connected at a joint and the joint includes a sub-flush radius on an underside of the joint.

The present teachings comprises: a plug comprising: a plurality of pins or a plurality of sockets; a body portion housing the plurality of pins or the plurality of sockets and the body portion extending parallel to a longitudinal axis of the plurality of pins or the plurality of sockets; a connection section connected to the body portion and extending from the body portion at an obtuse angle; and a cord connected to an end of the connection section; wherein the body portion and the connection section are connected at a joint and the joint includes a thumb ridge on a top side.

The present teachings provide: a plug comprising one or more pins; one or more collars extend around all or a portion of the one or more pins; and a boss with a generally circular inner bore and a generally D-shaped outer bore; and wherein the one or more collars and the one or more pins are located within the generally circular inner bore of the boss.

The present teachings provide: a plug comprising: one or more connection elements; a body portion housing the one or more connection elements and the body portion extending parallel to a longitudinal axis of the one or more connection elements; a connection section connected to the body portion and extending from the body portion at an obtuse angle; and a cord connected to an end of the connection section; wherein the body portion and the connection section are connected at a joint and the joint includes a sub-flush radius on an underside of the joint.

The present teachings provide: a plug comprising: one or more connection elements; a body portion housing the one or more connection elements and the body portion extending parallel to a longitudinal axis of the one or more connection elements, the body portion having: a top side, a bottom side, a first side extending between and connecting the top side to the bottom side, and a second side extending between and connecting the top side to the bottom side; a connection section connected to the body portion and extending from the body portion at an obtuse angle; and a cord connected to an end of the connection section; wherein the body portion and the connection section are connected at a joint and the joint includes a thumb ridge on the top side of the body portion.

The present teachings provide: a plug comprising: one or more connection elements; a boss with an inner bore and a generally D-shaped outer bore; and wherein the one or more connection elements are located within the inner bore of the boss.

The present teachings provide: a plug comprising: a keyed pin pattern and a D-shaped hilt.

The present teachings provide a plug with a body portion and a connection section that extend at an obtuse angle relative to each other. The present teachings provide a joint section that connects a body portion and a connection section together and the joint section includes a sub-flush radius. The present teachings provide a joint section that connects a body portion and a connection section together and the joint section includes a thumb ridge. The present teachings provide a plug with a boss that has a D-shaped outer bore. The present teachings provide a plug with a hilt that is D-shaped.

BRIEF DESCRIPTION OF THE DRAWINGS

FIG. 1 illustrates a generator including plugs and receptacles;

FIG. 2 illustrates a right rear perspective view of a plug;

FIG. 3 illustrates a left rear perspective view of the plug of FIG. 3;

DETAILED DESCRIPTION

Figure 4:
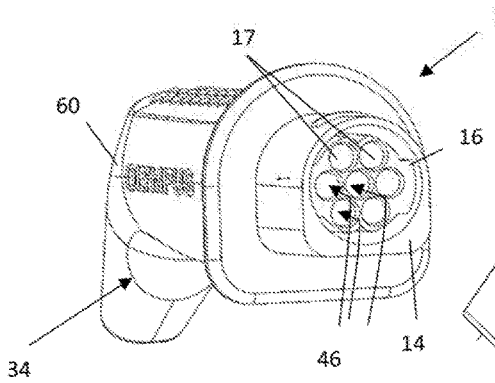
FIG. 4 illustrates a front perspective view of the plug of FIG. 3.

The explanations and illustrations presented herein are intended to acquaint others skilled in the art with the teachings, its principles, and its practical application. Those skilled in the art may adapt and apply the teachings in its numerous forms, as may be best suited to the requirements of a particular use. Accordingly, the specific embodiments of the present teachings as set forth are not intended as being exhaustive or limiting of the teachings. The scope of the teachings should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

The present teachings relate to a plug of a device and preferably an electrosurgical device. Preferably, the present teachings relate to a plug of an electrosurgical device and associated componentry that form an electrosurgical system. The electrical plug may be connected to a device in an electrosurgical system that may include one or more hand pieces, one or more ground pads, one or more generators, one or more electrosurgical devices, one or more adjacent hand piece components, or a combination thereof each device which are incorporated into the electrosurgical system. The electrical plug and electrosurgical device may be any device that may be used by a surgeon to perform a surgical procedure. The electrosurgical device may function to be switched between two or more configurations, two or more states, or both. For example, the electrosurgical device may be switched between a monopolar configuration, a bipolar configuration, a non-electrosurgical configuration, or a combination of the three. The electrosurgical device may be any device that may be switched between two or more configurations with one hand so that a user may switch between the configurations without the need for a second hand, without disrupting the procedure, or both. The electrosurgical device may be any device and/or configuration that may be used ambidextrously, ambidextrously switched between configurations, or both. The electrosurgical device may be used to cut, perform hemostasis, coagulate, desiccate, fulgrate, electrocautery, or a combination thereof. The electrosurgical device may be any device that includes bipolar capabilities, monopolar capabilities, non-electrosurgical capabilities, or a combination thereof. The electrosurgical device may be used in open surgery. In addition to its electrosurgical capabilities the electrosurgical device may be used for non-electrosurgical purposes. For example, the electrosurgical device may be used as forceps, tweezers, or both that may be used to grip an object, an organ, a vein, skin, tissue, the like, or a combination thereof. In another example, one or more parts of the device may include a sharp edge and may be used to cut, similar to that of a scalpel. The electrosurgical device may include a hand piece and a generator. The electrosurgical device may have one or more therapy signals that extend between the hand piece through the plug and to the generator; from the generator through the plug and to the electrosurgical device; or a combination of both.

The one or more therapy signals may be a signal, power, continuity, or a combination thereof. The one or more therapy signals may extend from the hand piece through the plug to the generator or vice versa. The one or more therapy signals may be formed by the hand piece, formed by the generator, or both. The electrosurgical therapy signals may be a therapy current. Preferably, the electrosurgical therapy signals indicate that a user has performed a step and a signal is being transmitted so that therapy current, energy, or both is generated. The electrosurgical therapy signals may provide a signal so that one or more therapy currents are produced and the therapy currents may be used for electrosurgery. The electrosurgical therapy signal may be a monopolar therapy signal, a bipolar therapy signal, or both. The electrosurgical therapy signal may be a monopolar therapy signal, a bipolar therapy signal, or both. The monopolar therapy signal may be any signal that has a voltage differential between a return port and an active port in the generator. The monopolar therapy signal may be any signal that when applied by the electrosurgical device extends from one pole of an electrosurgical device to another pole located at a remote location, off of the electrosurgical device, off the hand piece, or a combination thereof. The bipolar therapy signal may be any signal that has a voltage differential between two leads that are connected to the electrosurgical device, that are located in the generator, or both. The bipolar therapy signal may be any signal that when applied by the electrosurgical device extends from one component of a hand piece to another component of the hand piece (e.g., between two working arms, from a blade electrode to one or both working arms, or both). An electrosurgical therapy signal, when the activation circuit is in the second state, may exit the hand piece so that a therapy current extends from a blade electrode, between the first working arm and the second working arm, between the blade electrode and one or both of the working arms, or a combination thereof. The therapy signal may be generated and conducted from the hand piece to the generator.

The generator may be any device that supplies power, a therapy current, control signals, an electrosurgical therapy signal, electronically reconfigures itself in response to a signal from the user, physically reconfigures in response to adjustments by the user, or a combination thereof. The generator may function to be electrically connected to a hand piece to provide and/or receive electrosurgical therapy signals, power, therapy current, or a combination thereof. The generator may be connected to a hand piece, an electrosurgical device, or both via a plug. The generator may be capable of producing only a single therapy current. The generator may be capable of producing two therapy currents. The generator may include two or more receptacles, three or more receptacles, or four or more receptacles. The receptacles may be any port in the generator that receive a plug so that one or more plugs of the hand piece may be plugged into so that power, control signals, therapy currents, or a combination thereof are supplied to the electrosurgical device.

The one or more receptacles function to receive a plug. The one or more receptacles function to form a mechanical connection, an electrical connection, or both with a plug. The one or more receptacles may function to have all or a portion that inserts into a plug. The one or more receptacles may be or include a recess, a projection, or both. The one or more receptacles may be a female part, a male part, or both. The one or more receptacles may be substantially located within the generator and may have a portion that is accessible from an outside of the generator. The receptacle may be complementary in shape to the plug, a boss of the plug, an insertion section, one or more collars, one or more through holes, one or more pins, or a combination thereof. The receptacle may be generally D-shaped. The receptacle may include a generally D-shaped portion. The receptacle may include an asymmetrical portion. The receptacle may include a symmetrical portion. The receptacle may include a circle. The receptacle may include a circular portion inside of a D-shaped portion. The receptacle may have one or more flat walls, one or more arcuate walls, or both. The receptacle may include one or more sockets or a plurality of sockets; one or more pins or a plurality of pins; one or more connection elements or a plurality of connection elements; or a combination thereof.

The one or more connection elements function to connect a plug to a generator or a plug to a receptacle. The one or more connection elements may function to electrically connect, signally connect, or both an electrosurgical device to a generator. The one or more connection elements may have a pattern. The pattern may key one connection element to another connection element. The one or more electrical connectors may be a male piece, a female piece, or both. The one or more electrical connectors may be removably connected together. The one or more electrical connectors may be a pin, a socket, or both. The one or more connection elements may be a conductive pin connected to an electrical lead and a matching conductive socket that is connected to a lead that are matched together to create an electrical connection. The one or more electrical connectors may be located in the receptacles, the plugs, or both. For example, the plug may have a plurality of connection elements that are pins and the receptacles may have a plurality of connection elements that are sockets and the pins may extend into the sockets to form a connection. The one or more sockets may be located inside of the receptacles, the pins, or both. The one or more sockets may include pins. Preferably, the one or more sockets receive the pins or a collar of the pins to form a connection. The one or more sockets may be pinion sockets (e.g., sockets that receive pins). Each of the sockets may be an individual socket that receives an individual pin. The one or more sockets may be connected to a lead and the one or more sockets may connect a pin to the lead connected to the one or more sockets so that power, signals, or both are transferred between the sockets and the pins. Each of the one or more sockets may be connected to a lead. The one or more sockets may be keyed. The one or more sockets may be located in a pattern that may be a keyed. The one or more sockets may be a plurality of sockets. The plurality of sockets may have a pattern that is complementary to that of the pins, the collars, or both. The one or more sockets may be located in a pattern so that the plug can only be installed in one configuration. The one or more sockets may be a female piece that receives the collars of the plug. The one or more sockets may have a metal portion that contacts a pin so that signals, power, or both are transferred when an electrical connection is formed. The one or more sockets may be made of gold, silver, copper, nickel, or a combination thereof. The one or more sockets may be a male piece that extends into the collars of the plug. Preferably, the receptacles may include a plurality of sockets. More preferably, the receptacles may include the same number of sockets as the plug includes collars, pins, or both.

The one or more plugs may function to form a connection between a surgical device and the generator. The one or more plugs may function to form a mechanical connection, an electrical connection, or both between the one or more plugs and the generator. The one or more plugs may have internal pins, external pins, or both. The one or more plugs function to form an interface with a generator that powers an electrosurgical device. The one or more plugs may be connected to and extend from an electrosurgical device. The one or more plugs may include a cord. The one or more plugs may plug into a generator to provide a therapy current to an electrosurgical device. The one or more plugs may include a body portion, a connection section, and a joint that connects the body portion to the connection section.

The body portion may function as a gripping portion for a user so that a user can connect the plug to a receptacle. The body portion functions to remain outside of the generator. The body portion functions as a main part of the plug. The body portion may house electrical components of the plug. The body portion may house one or more pins. One or more pins may be recessed within the body portion. The one or more pins may extend cantilever from the body portion. A boss may extend cantilever from the body portion. The body portion may include one or more and preferably a plurality of grips. The body portion includes a length. The length of the body portion extends along a longitudinal axis. The electrical plug may attach or detach to the generator along the longitudinal axis of the body portion. The body portion is located between a boss and a joint. The body portion, the connection sections, the joint, the hilt, the boss, or a combination thereof may have a top, bottom, left (e.g., first side), right (e.g., second side), or a combination thereof. The left side may extend between and connect the top to the bottom. The right side may extend between and connect the tope to the bottom. The top may be located above the bottom. The top and bottom may be relative to the direction of gravity. Each of the parts of the plug, adapter, or both may include a top, bottom, left, right, or a combination thereof. The top may be located above the bottom. The boss of the body portion may have a top, bottom, and two side walls (e.g., left and right). The boss, hilt, inner bore, adapter, or a combination thereof may include one or more flat walls, one or more arcuate walls, a top, bottom, left (e.g., a first side), right (e.g., a second side), a "D" shape, or a combination thereof.

The "D" shape may function to create a direction the plug can connect to a generator, an adaptor, or both. The "D" shape may be one flat wall and one arcuate wall. The D shape may include a semi-circle. The D shape may include two parallel side segments. The two parallel side segments may be tangential to an arcuate segment. The D shape may include a segment that is perpendicular to and connected the two parallel side segments. The D shape may have three flat walls. The D shape may have one arcuate wall that extends between and connects two flat walls and a third flat wall located opposite the arcuate wall that connects the two flat walls.

The one or more flat walls may function to create a shape that creates a connection configuration between a plug and a socket. The one or more flat walls may create a top, bottom, left, or right. The flat wall may be located downward (i.e., at a bottom of the body portion). The flat wall may be located upward (i.e., at a top of the body portion). The one or more flat walls may key the boss, hilt, inner bore, adapter, or a combination thereof. The one or more flat walls may indicate a top of the plug or adapter. The one or more flat walls may indicate a bottom of the plug or adapter. The one or more flat walls be complementary to a flat wall of another component. For example, a flat wall of an inner bore may align with a flat wall of an adapter. The one or more flat walls may be located proximate to the one or more arcuate walls.

The one or more arcuate walls may key a pin relative to a socket. The one or more arcuate walls may key an inner bore relative to an adapter. The one or more arcuate walls may be complementary in shape to an arcuate wall of another part. The arcuate walls of two or more parts (e.g., plug or adapter) may be located proximate to each other. For example, the boss, hilt, and inner bore may all include an arcuate wall and a flat wall and the flat walls and the arcuate walls may align with each other. The arcuate wall of one part may be located proximate an arcuate wall of another part. For example, an arcuate wall of a boss may be located proximate to a flat wall of a hilt. Preferably, the hilt indicates a position of an arcuate wall within the inner bore. An arcuate wall may be located inside and outside of a boss.

The boss may function to extend fully or partially into a receptacle to form a connection with the receptacle. The boss functions to receive a portion of the receptacle to form a connection. The boss functions to support the pins, protect the pins, or both. The boss may surround the one or more pins and preferably a plurality of pins. The body portion may be free of a boss. For example, when a jack pin extends from the body portion the body portion may be free of a boss. The boss may function to orient the plug relative to the receptacle. The boss may be complementary in shape to the receptacle. The boss may be generally "D-shaped." The boss may be D-shaped. The boss may have one or more flat sides and one or more arcuate sides. Preferably, and exterior of the boss may be D-shaped. The boss may be asymmetrical. The boss may include an interior that is keyed to a part of the receptacle. The boss may include a symmetrical shaped interior. The boss may include an asymmetrically shaped interior. The boss may include a circular interior. The boss may include an interior that is D-shaped. The boss and receptacle may be keyed so that the plug and receptacle can only fit in one configuration. The boss may extend beyond the pins, beyond the insertion section, beyond the collar, beyond the connection elements, or a combination thereof. The boss may be recessed and the pins, insertion section, collar, or a combination thereof may extend beyond the boss. The boss may house the pins, insertion section, collar, or a combination thereof. The boss may include one or more locks to lock the plug to the receptacle. The one or more locks may function to form a fixed connection with the receptacle, the generator, or both. The one or more locks may be located on a boss, a hilt, or both. The one or more locks may extend into the receptacle to form a locked connection. The one or more locks may receive a portion of the receptacle to form a locked connection. The one or more locks may be a detent, a recess, a raised surface, or a combination thereof. The one or more locks may be unidirectional. The one or more locks may create a friction surface so that the plug is harder to remove than to install. The one or more locks may prevent the plug from falling out of the receptacle. The one or more locks may be located at virtually any location of the plug. Preferably, the lock is located on a top of boss (i.e., at the 12 o'clock position). The lock may align the plug within the receptacle. The lock may work in conjunction with an insertion section, an inner bore, outer bore, a flat wall, an arcuate wall, or a combination thereof to form a connection within a receptacle.

The one or more inner bores may function house the one or more pins, the one or more sockets, or both. The one or more inner bores may be circular. The one or more inner bores may be "D" shaped. The one or more inner bores may have a complementary shape to a recess within the adapter. The one or more inner bores may have a complementary shape to an inside of the adapter. The inner bore and an outer bore may have a same shape. The outer bore may be an outside of the boss and the inner bore may be an inside of the boss. A wall between the inner bore and the outer bore may have a uniform wall thickness therebetween. The uniform wall thickness may form the inner bore and the outer bore to have the same shape. The wall thickness between the inner bore and the outer bore may vary so that the shape of the inner bore and the outer bore may be different. The inner bore, the outer bore, or both may be square, circular, "D" shaped, oval, hexagon, pentagon, octagon, or a combination thereof. The outer bore may have a first shape and the inner bore may have a second shape. The outer bore may be "D" shaped and the inner bore may be circular. The one or more inner bores may include a collar wall.

The one or more collar walls may separate the pins from a recess. The one or more collar walls may include one or more collars, one or more insertion recesses, or both. The one or more collar walls may separate one or more pins from one or more sockets. The one or more collar walls may fit within the inner bore. The one or more collar walls may form a barrier that protects the pins, the sockets, or both. The one or more collar walls may include one or more insertion recesses and preferably two or more insertion recesses.

The insertion recesses function to receive one or more insertion sections. The insertion recesses may be a cavity, aperture, through hole, a depression, or a combination thereof in the collar walls. The insertion recesses may receive an insertion section so that the socket and plug are connected together. The insertion recesses may be semicircular in shape. The insertion recesses may be located in a periphery of the collar walls. The insertion recesses may be formed between the insertion wall and the inner bore of the boss. The insertion recesses may be round, square, rectangular, have an arcuate portion, or a combination thereof. The insertion recesses may be complementary in shape to the insertion sections. The insertion section may function to align the plug within the receptacle. The insertion section may be located between the boss and the one or more collars. The insertion section may function to support the collars. The insertion section may be keyed to the receptacle, the sockets or both. For example, the receptacle may include a projection that extends between one or more pieces of the insertion section. In another example, the receptacle may include cut outs that the insertion section extends into. The insertion section may be a projection that extends into a part of the receptacle. The electrical plug may be free of an insertion section. The insertion section may be one solid piece. The insertion section may be generally circular. The insertion section may include gaps between pieces of the insertion section. The insertion section may be an absence of material around the collars. The insertion section may substantially surround the collars.

The one or more collars may function to protect the pins. The one or more collars may function to extend into sockets in the receptacle. The one or more collars may function to receive the one or more sockets of the receptacle. The one or more collars may be a plurality of collars. Preferably, the collars are generally circular (in the cross-section) or generally cylindrical (in three-dimensional). The one or more collars may be symmetrical, asymmetrical, square, rectangular, octagonal, pentagonal, diamond, star, or a combination thereof. The one or more collars may be a single collar. The one or more collars may be solid piece that includes through holes there between. Each of the through holes of the collar may include a pin. Preferably, the one or more collars are a plurality of collars. The plurality of collars may be piece that extends parallel to the longitudinal axis of the pins, the boy portion, or both. The plurality of collars may have a pattern. The electrical plug may include 1 or more, 2 or more, 3 or more, 4 or more, 5 or more, 6 or more, 7 or more, 8 or more, or more collars. Preferably, the plug includes seven collars. The pattern of the collars may be complementary to the pattern of the sockets. The one or more collars may each include one or more pins. However, some collars may be free of pins.

The one or more pins may function form a connection. A connection may be an electrical connection, a mechanical connection, or both. Preferably, the pins and sockets form an electrical connection and the surrounding parts (e.g., inner bore, collar, insertion recess, insertion section, attachment features) form a mechanical connection. The one or more pins may function to send or receive therapy signals, power, or both. The one or more pins may be connected to leads. Each pin may be connected to a lead. The pins may transfer power, signals, or both from the leads connected to the pins to the leads connected to the sockets. The one or more pins may extend into a socket. The one or more pins may be keyed. The one or more pins may have a pattern that is complementary to the pattern of the sockets. The one or more pins may be solid. The one or more pins may be movable. The one or more pins may be spring loaded. The one or more pins may form a connection by contacting a contact portion at an end of a socket. The one or more pins may form a connection by contacting a sidewall of the socket. The one or more pins may be a plurality of pins. The plurality of pins may be 3 pins or more, 4 pins or more, 5 pins or more, 6 pins or more, 7 pins or more, or 8 pins or more. The one pin may be a jack pin. The jack pin may extend cantilever from the plug, the boss, or both. The one or more pins may be three pins and the three pins. The three pins may extend cantilever from the plug, the boss, or both. The one or more pins may be recessed within the boss, the body portion, the plug, or a combination thereof. The one or more pins may be made of any conductive material. The one or more pins may be made of steel, iron, copper, silver, gold, titanium, aluminum, or a combination thereof. The one or more pins may be located distal of a hilt connected to the body portion.

The one or more hilts function to prevent the plug from moving when the pug is set on a flat surface. The one or more hilts may fit within the receptacle. The electrical plug may rest on the hilts when the plug is connected to the generator. The hilt may prevent the plug from angling downward. For example, the hilt may prevent the plug from being pulled down by the cord when the plug is connected to the generator so that the plug remains substantially normal to the generator during a connection. The hilt may have a flat wall on the bottom. The hilt may have an arcuate wall on the bottom. The one or more hilts may function to orient the plug. The one or more hilts may circumscribe a portion of the plug. The one or more hilts may form a periphery around the plug. The one or more hilts may extend along one side of a hilt (e.g., top, bottom, left, right). The one or more hilts may be made of or include rubber, plastic, a thermoplastic, metal, or a combination thereof. The electrical plug may be free of hilts. The one or more hilts may be generally D-shaped. The one or more hilts may include a flat edge. The one or more hilts may be symmetrical, asymmetrical, square, round, have chamfered edges, flat edges, or a combination thereof. The one or more hilts may be located on an opposite end of the body portion as a ridge. The one or more hilts may be located on an opposite side of the body portion as a ridge (e.g., ridge is located on the top and the hilt is located on the bottom).

The one or more ridges may function to provide grip to one or more fingers and preferably a thumb. The one or more ridges may function to provide a contact location for a finger or thumb. The one or more ridges may be an elevated section of the body portion. The one or more ridges may be an elevated portion of a joint. The one or more ridges may be an elevated portion of a connection section. The one or more ridges may extend from a connection section through the joint and to the body portion. The one or more ridges may be located on a top of the plug. The one or more ridges may be located proximate to a cord. The one or more ridges may be a thumb ridge. The one or more ridges may be solid. The one or more ridges may be flexible. The one or more ridges may be made of the same material as the body portion. The one or more ridges may be made of a different material as the body portion. The one or more ridges may indicate a top of the plug. The one or more ridges may be used with or in lieu of grips.

The one or more grips may function to provide an increased friction section relative to a smooth section. The one or more grips may function to tactically indicate a top of the plug. The one or more grips may be a unitary part of the plug. The one or grips may be added to the plug. The one or more grips may be located on the body portion, connection section, joint, or a combination thereof. The one or more grips may be a rubber piece that is added to the plug. The one or more grips may be a solid piece that is connected to the plug. The one or more grips may be a plurality of geometric shapes located on a surface of the plug. The geometric shapes may be randomly oriented, in lines, is patterns, or a combination thereof. The one or more shapes may be circular, square, rectangular, domes, egg shaped, or a combination thereof. The one or more grips may be a raised portion on a surface of the plug. The one or more grips may be used with or instead of a radius. Preferably, the radius is located on a bottom or underneath the plug and the grips are located on a top or upper side of the plug.

The one or more radii (hereinafter radius even when plural) may function to support one or more fingers. The radius may be a plurality of radii. For example, the plug may include two or more radius in series. The radius may be located in the body portion, connection section, joint, or a combination thereof. The radius may be a finger relief. The radius may be a sub-flush radius. The finger relief may be an absence of material. The finger relief may be a generally round shape at the joint, between the body portion and the connection section. The finger relief may fit a finger. The finger relief may be located on an underside of the plug. The finger relief may prevent the plug from slipping in a user's hand. The finger relief may be located at a center of gravity of the plug. The finger relief may be located so that the plug is balanced on the finger relief. The finger relief may be located opposite a ridge. The radius may be formed in the plug. The radius may be material that is removed from the plug. The radius assist in indicating a position of the plug. The radius may be a tactile indicator. In addition to the radius the plug may include one or more visual indicators.

The one or more indicators may function to indicate to a user what position is up. The one or more indicators may be visual, tactile, or both. The one or more indicators may be located on the boss, the hilt, or both. The one or more indicators may indicate a direction of alignment. The one or more indicators may align with an indicator on the generator, receptacle, or both. The one or more indicators may be an arrow. The one or more indicators may be printed on the plug. The one or more indicators may be a molded part of the plug. The one or more indicators may be located proximate to one or more attachment features.

The one or more attachment feature may function to connect a plug, an adapter, or both to a generator. The one or more attachment features may connect an adapter to a plug. The one or more attachment features may include one or more through holes. The one or more attachment features may receive one or more fasteners (e.g., screw, bolt, nail, or rivet). The one or more attachment features may be located on one or more sides, and preferably two or more sides of the plug or adapter. The one or more attachment features may be dog ears on opposing sides of a plug or adapter. The one or more attachment features may extend outward from a body portion, a boss, or both. The one or more attachment sections may be used to connect an adapter to a generator so that the generator may be converted to use a different style plug.

The one or more adapters may function to adapt a receptacle to fit a plug as is taught herein. The one or more adapters may adapt a standard receptacle to a receptacle with a keyed configuration as is taught herein. The one or more adapters may be a female plug. The one or more adapters may be attached to a generator, inserted in a generator, attached to a plug, or a combination thereof. The adapter may include any or all of the components discussed herein for generator or plug. The adapter may be located in a generator so that the adapter is in a direction of a longitudinal axis of a plug.

The electrical plug may include one or more longitudinal axes. Preferably, the plug includes two longitudinal axis. One longitudinal axis (i.e., body longitudinal axis) extends along a length of the body portion, in a direction of the pins, in a direction of the collar, in a direction of the through holes, or a combination thereof. The longitudinal axis of the body portion may extend in a direction that the plug is moved to create a connection. A second longitudinal axis (i.e., connection longitudinal axis) may extend in a direction along a length of the connection section, along the cord, or both. The connection longitudinal axis may extend downward relative to the body longitudinal axis. The body longitudinal axis may extend normal to a face of the generator and the connection longitudinal axis may extend downward (e.g., in the direction of gravity) at an angle relative to a bottom of the body portion. The connection longitudinal axis and the body longitudinal axis may extend at an angle relative to each other. The angle may be an obtuse angle. The angle may be more than 90 degrees. The angle may be less than 180 degrees. The angle may be about 95 degrees or more, about 105 degrees or more, about 125 degrees or more. The angle may be about 175 degrees or less, about 155 degrees or less, or about 140 degrees or less (i.e., about 135 degrees). The angle may be created by the joint. The angle may extend between the body portion and the connection section.

The one or more connection sections may function to connect a cord to the plug. The one or more connection sections may function to connect a cord to the body portion, a joint, or both. Preferably, the plug includes one connection section. The one or more connection sections may extend at an obtuse angle relative to the body portion. The one or more connection sections may extend at an angle relative to the body portion (e.g., extends downward relative to the body portion). The connection section may be located under the body portion (i.e., downward) when the plug is properly installed in the generator, the socket, or both. The one or more connection sections may be connected to the body portion by a joint. The one or more connection sections may include a ridge, a grip, a radius, a finger relief, or a combination thereof. The one or more connection sections connect to a cord.

The one or more cords provide a therapy signal, a therapy signal, power, electricity, control signals, or a combination thereof between a generator and a electrosurgical device. The one or more cords extend into the plug and electrically connect the plug to the electrosurgical device. The one or more cords may include one or more wires that transfer the therapy signals between the generator and/or plug and the electrosurgical device. Then one or more cords may extend into and be integrally connected into the plug. The one or more cords may extend out of the plug at an angle relative to the body portion. The one or more cords may extend out of the plug in a direction that is substantially downward (e.g., 15 degrees or less, 10 degrees or less, or about 5 degrees or less from vertical (i.e., the direction of gravity)).

The joint may function to connect the body portion to the connection section. The joint may function to angle the connection section relative to the body portion. The joint may be rounded between the connection section and the body portion. The joint may be angled between the connection section and the body portion. The joint may include a radius, a ridge, grips, or a combination thereof. The joint may create the angle discussed herein, the two longitudinal axes discussed herein, or both. The joint may allow all of the wires from the cord to extend between the connection section and the body portion so that the cord powers an electrosurgical device.

The electrical plug may be reusable. The electrical plug may be disposable. The electrical plug may be made of a material that may be placed in an autoclave, be placed in a liquid solution, or both. The plug may be made of a plastic that may be one time use. The electrical plug may cleaned with the surgical device. The electrical plug may be removable from the electrosurgical device so that the electrosurgical device may be cleaned and the plug may be discarded. The electrical plug that is disposable may be made of different materials than a plug that is reusable.

FIG. 1 illustrates a generator 2. The generator 2 includes a plurality of receptacles 4 for receiving plugs 10. As shown, some of the receptacles 4 have plugs 10 inserted therein. Each of the receptacles 4 include sockets 6 that receive pins (not shown) in the plug 10.

FIG. 2 illustrates a rear perspective view of the plug 10. The electrical plug 10 includes a body portion 12, a connection section 50 and a joint 60 that connects the body portion 12 to the connection section 50. A boss 14 extends from the body portion 12. The boss 14 includes a lock 22 for connecting the plug 10 to a receptacle (not shown). A hilt 20 extends between the boss 14 and the body portion 12. The body portion 12 includes a plurality of grips 32. The body portion 12 includes a longitudinal axis 44 that extends along the length of the body portion 12 and parallel to the pins (not shown). The connection section 50 includes a connection longitudinal axis 52 that extends along the length of the connection section 50 and parallel to a cord (not shown). A joint 60 extends at an angle relative to the body portion 12 and the connection section 50 so that the longitudinal axis 44 of the body portion 12 and the longitudinal axis of the connection section 50 extend at an angle (a) relative to each other.

FIG. 3 illustrates a perspective view of the plug 10 from an opposite side as FIG. 2. The electrical plug includes a cord 54 extending into a connection section 50. The connection section 50 is connected to a joint 60 on a first side of the joint 60 and the joint is connected to a body portion 12 on a second side of the joint 60. The joint 60 includes a radius 34 located on a bottom or underside of the joint 60. The body portion 12 and boss 14 are separated by hilt 20.

FIG. 4 illustrates a front view of the plug 10. The radius 34 (e.g., a finger relief) is shown on the underside of the joint 60. The boss 14 as shown is generally "D-shaped" and extends around a single collar 14 that includes a plurality of through holes 17. Each of the plurality of through holes 17 include a connection element 46 that forms a connection with a connection element of a generator (not shown).

Figure 5:
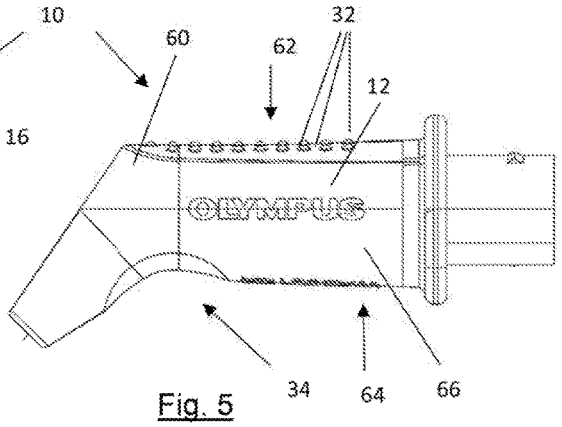
FIG. 5 illustrates a side view of the plug of FIG. 3.

FIG. 5 illustrates a side view of the plug 10. The electrical plug includes a top 62, a bottom or underside 64, a first side 66 that connects the top 62 to the bottom 64, and a second side (not shown that connects the top 62 to the bottom 64. A radius 34 is located on the bottom 64 of the body portion 12 and joint 60. A plurality of grips 32 extend along a top 62 of the body portion 12 and the joint 60.

Figure 6:
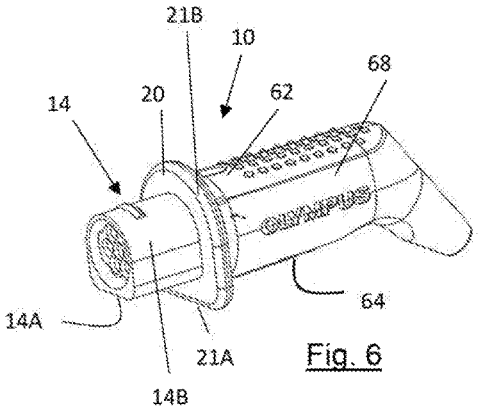
FIG. 6 illustrates a front side perspective view of the plug of FIG. 3.

FIG. 6 illustrates a front perspective view of a plug 10. The electrical plug 10 includes a hilt 20 having an arcuate wall 21B and a flat wall 21A so that the hilt 20 is generally "D" shaped. The electrical plug 10 has a top 62, a bottom 64, and a second side wall 68 that connects the top 62 to the bottom 64. The flat wall 21A of the hilt 20 as shown is located on the bottom 64 of the plug 10. The electrical plug 10 includes a boss 14 with an arcuate wall 14B and a flat wall 14A. The flat wall 14A of the boss 14 and the flat wall 21A of the hilt 20 are both located on the bottom 64 of the plug.

Figure 7A:
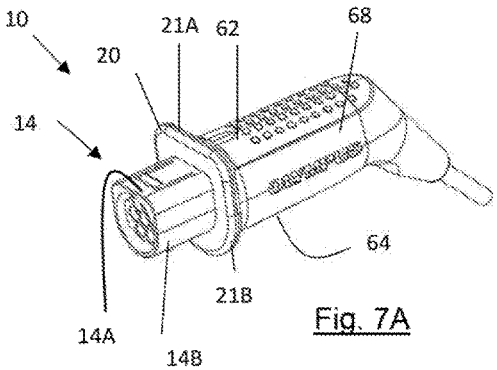
FIG. 7A is a front perspective view of a plug.

FIG. 7A illustrates a front perspective view of a plug 10. The electrical plug 10 includes a hilt 20 having an arcuate wall 21B and a flat wall 21A so that the hilt 20 is generally "D" shaped. The electrical plug 10 has a top 62, a bottom 64, and a second side wall 68 that connects the top 62 to the bottom 64. The flat wall 21A of the hilt 20 as shown is located on the top 62 of the plug 10. The flat wall 21A of the hilt 20 as shown is located on the top 62 of the plug 10. The electrical plug 10 includes a boss 14 with an arcuate wall 14B and a flat wall 14A. The flat wall 14A of the boss 14 and the flat wall 21A of the hilt 20 are both located on the top 62 of the plug.

Figure 7B:
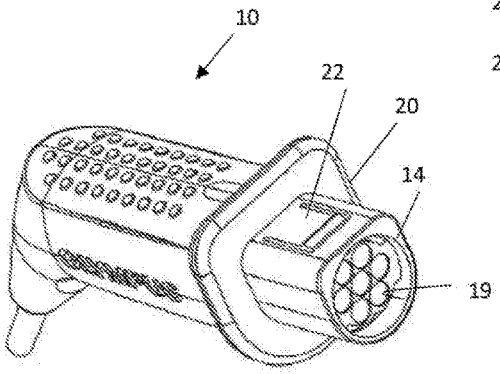
FIG. 7B is a side perspective view of the plug of FIG. 7A.

FIG. 7B illustrates a perspective view of a front side of the plug 10 of FIG. 7A. The boss 14 is shown have a circular inner bore 19 and a lock 22. The electrical plug 10 includes a hilt 20 that has a mirror shape to that of the boss 14.

Figure 7C:
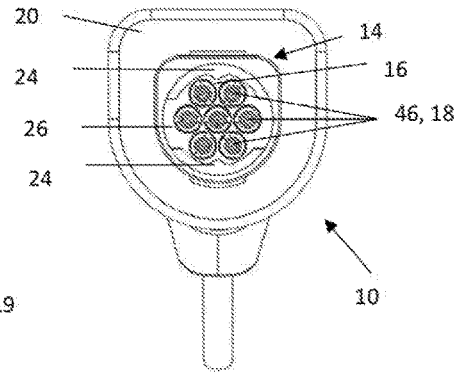
FIG. 7C is a front view of the plug of FIG. 7A having a circular inner bore.

FIG. 7C illustrates a front view of the plug 10 of FIG. 7A. The electrical plug 10 includes a boss 14 and a hilt 20 that have substantially the same shape. The boss 14 includes a collar wall 26 that includes a pair of insertion recesses 24 that receive insertion sections (not shown) of an adapter (not shown) to form a connection. The collar wall 26 includes collars 16 that extend around connection elements 46 which as shown are pins 18.

Figure 7D:
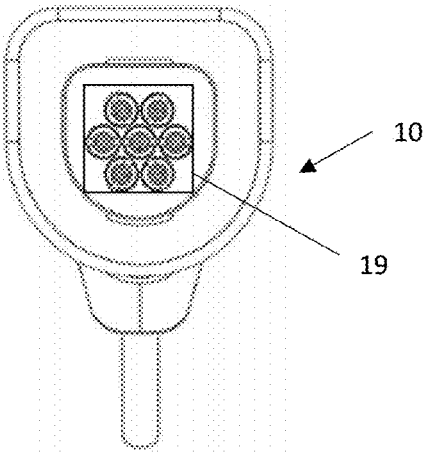
FIG. 7D is a plug having a square inner bore.

FIG. 7D illustrates a front view of a plug 10 having a square inner bore 19.

Figure 7E:
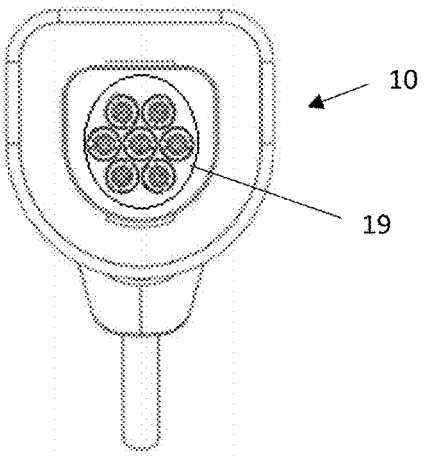
FIG. 7E is a plug having an oval inner bore.

FIG. 7E illustrates a front view of a plug 10 having an oval inner bore 19.

Figure 7F:
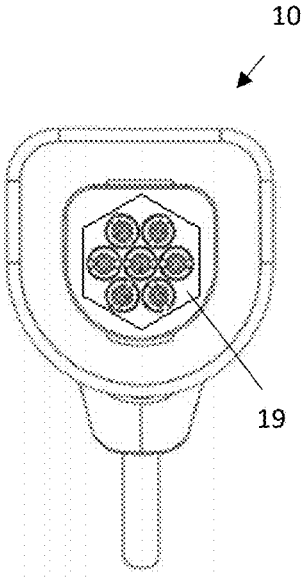
FIG. 7F is a plug having a hexagon inner bore.

FIG. 7F illustrates a front view of a plug 10 having a hexagon inner bore 19.

Figure 7G:
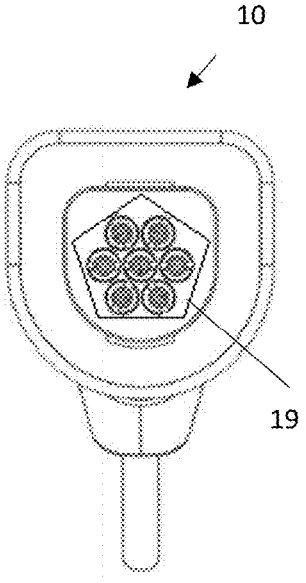
FIG. 7G is a plug having a pentagon inner bore.

FIG. 7G illustrates a front view of a plug 10 having a pentagon inner bore 19.

Figure 7H:
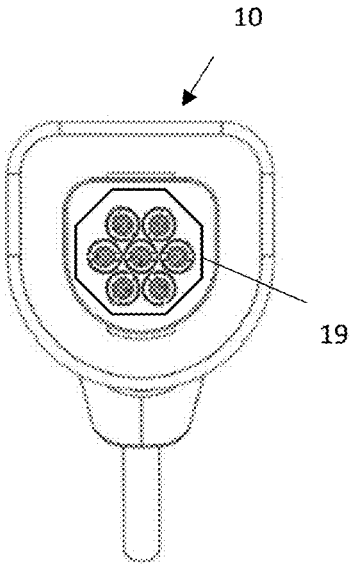
FIG. 7H is a plug having an octagon inner bore.

FIG. 7H illustrates a front view of a plug 10 having an octagon inner bore 19.

Figure 8:
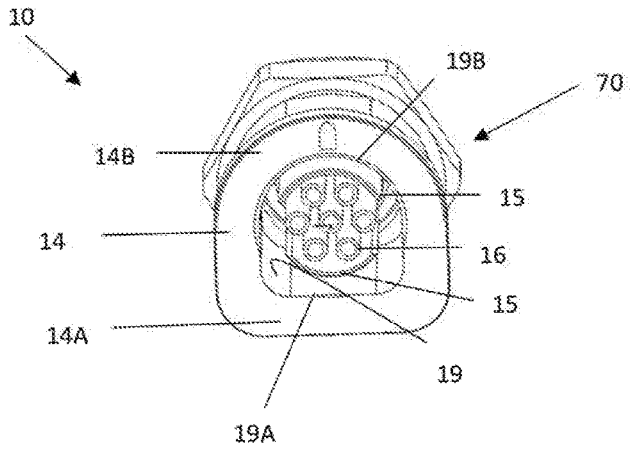
FIG. 8 illustrates a front top perspective view of an adapter.

FIG. 8 is a perspective view of a front and top side of a plug 10 that is an adapter 70. The adapter 70 includes a boss 14 that has a flat wall 14A and an arcuate wall 14B. The boss 14 includes an inner bore 19 that includes a flat wall 19A and an arcuate wall 19B. Two insertion sections 15 and a plurality of collars 16 are located within the boss.

Figure 9A:
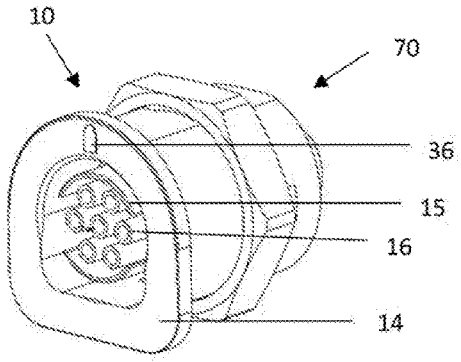
FIG. 9A illustrates front perspective view of the adapter of FIG. 8.

FIG. 9A illustrates a front perspective view of the adapter 70 of FIG. 8 that is part of a plug 10. The adapter 70 includes a boss 14 with an indicator 36. The indicator 36 indicates which way is up and the boss 14 is generally D-shaped. An insertion section 15 is located within the boss 14, and a plurality of collars 16 are located inside of the insertion section 15. The indicator 70 may be incorporated into the plug 10 or the generator (not shown) and assists in forming a connection or adapting a pre-existing plug to or receptacle to form a connections.

Figure 9B:
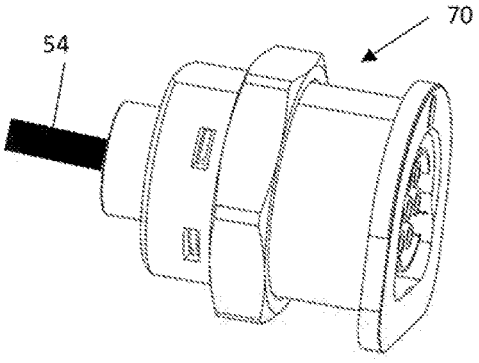
FIG. 9B illustrates a side perspective view of the adapter of FIG. 8.

FIG. 9B is a side perspective view of an adapter 70. The adapter 70 is connected to a cord 54 that provides and/or receives power, signals, or both.

Figure 10:
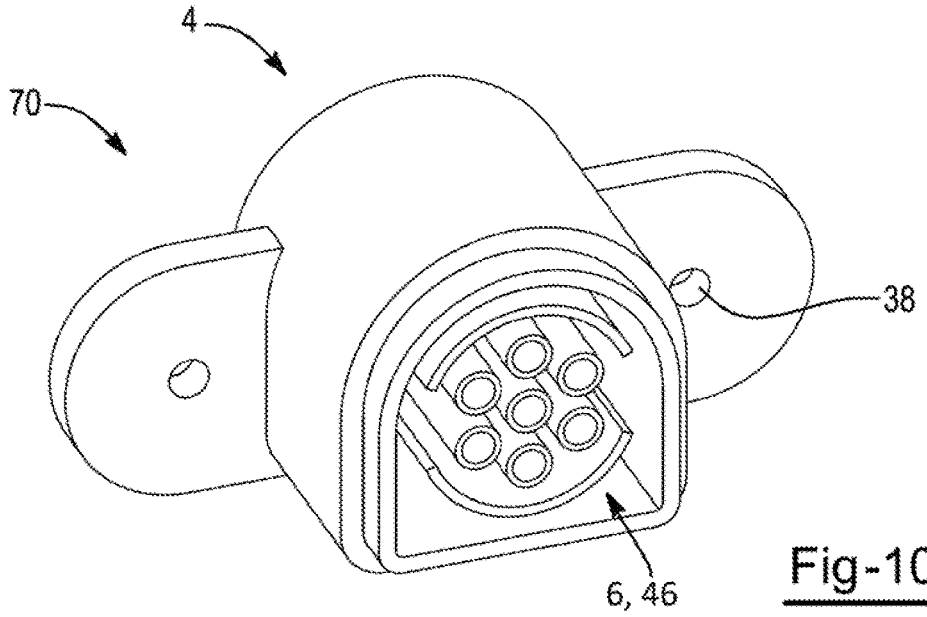
FIG. 10 illustrates a perspective view of an adapter.

FIG. 10 is a front perspective view of an adapter 70. The adapter 70 as shown is part of a receptacle 4 and includes a plurality of connection elements 46 that are shown as sockets 6 for receiving pins (not shown). However, the sockets 6 may include pins. A pair of opposed attachment features 38 extend from the adapter 70 for connecting the adapter 70 to a desired component.

Figure 11:
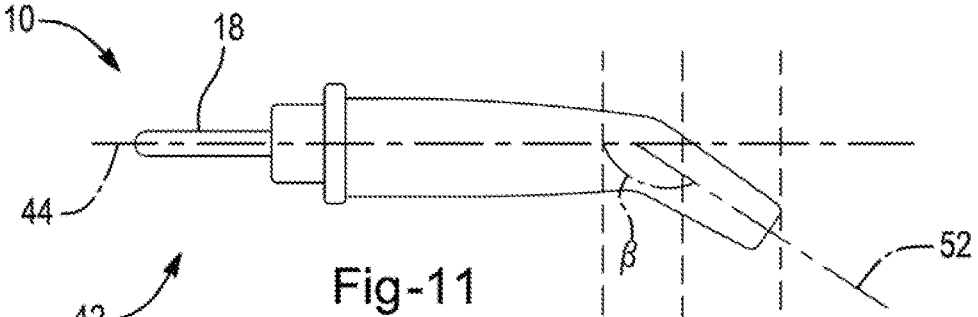
FIG. 11 illustrates a side view of a plug.

FIG. 11 illustrates a side view of a plug 10. The electrical plug 10 includes three pins 18.

Figure 12:
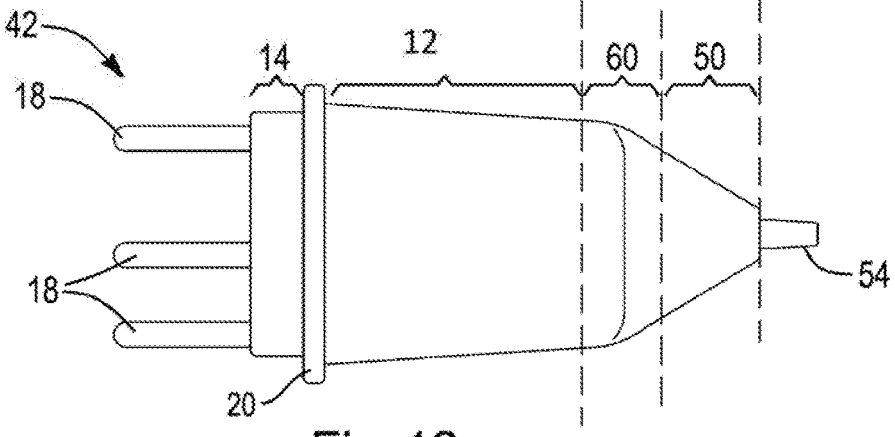
FIG. 12 illustrates a top view of the plug of FIG. 12.

FIG. 12 includes a top view of the plug 10 of FIG. 12 and shows the pins 18 extending from the boss 14. As is shown in FIGS. 11 and 12 the joint 60 is angled so that a longitudinal axis 44 of the body portion 12 extends and an angle (β) relative to the connection longitudinal axis 52 of the connection section 50. The boss 14 is separated from the body portion 12 by a hilt 20. The body portion 12 and connection section 50 are connected together by a joint 60. A cord 54 extends from the connection section 50.

Figure 13:
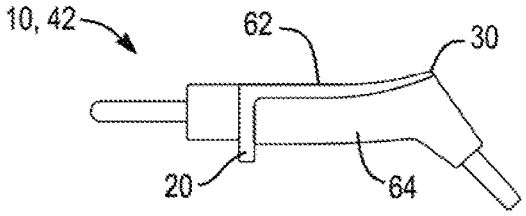
FIG. 13 illustrates a side view of a plug.

FIG. 13 illustrates a side view of a plug 10 that is disposable 42. The electrical plug 10 includes a hilt 20 only on a bottom side 64 and includes a ridge 30 on a top side 62.

Figure 14:
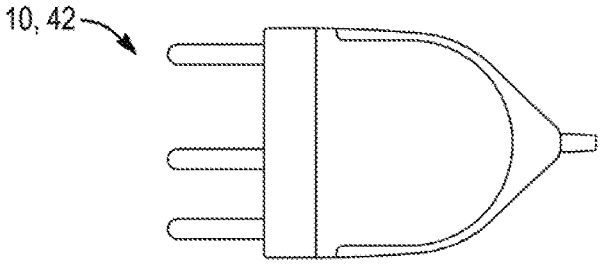
FIG. 14 illustrates a side view of the plug of FIG. 13.

FIG. 14 illustrates a top view of a plug 10 of FIG. 13 that is disposable 42.

Figure 15:
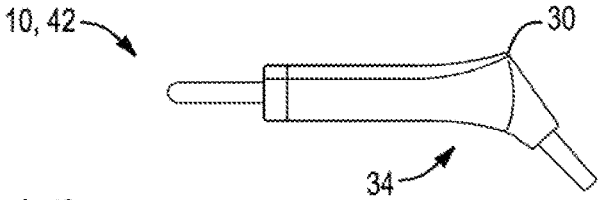
FIG. 15 illustrates a side view of a plug.

FIG. 15 illustrates a side view of a plug 10 that is disposable 42. The electrical plug 10 includes a radius 34 on a bottom side and includes a ridge 30 on a top side.

Figure 16:
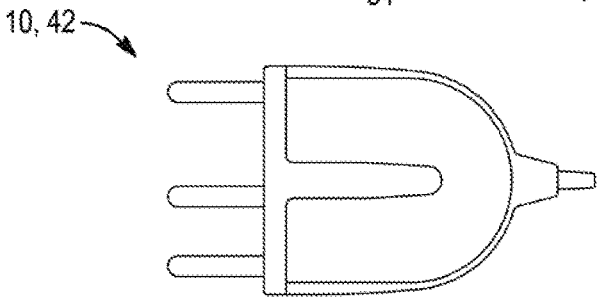
FIG. 16 illustrates a top view of the plug of FIG. 15.

FIG. 16 illustrates a top view of a plug 10 that is disposable 42.

Figure 17:
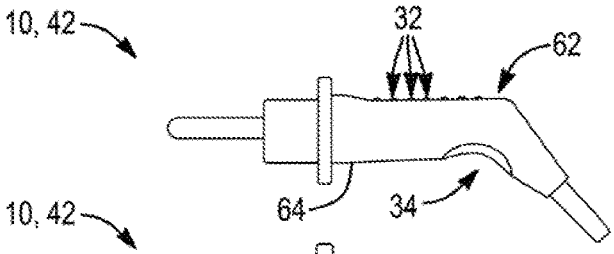
FIG. 17 illustrates a side view of a plug.

FIG. 17 illustrates a side view of a plug 10 that is disposable 42. The electrical plug 10 includes a radius 34 on a bottom side 64 and a plurality of grips 32 on a top side 62.

Figure 18:
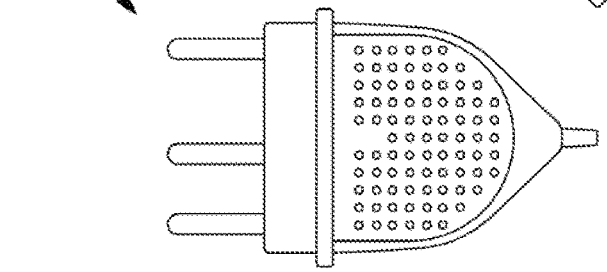
FIG. 18 illustrated a top view of the plug of FIG. 17.

FIG. 18 illustrates a top view of a plug 10 of FIG. 17 that is disposable 42.

Figure 19:
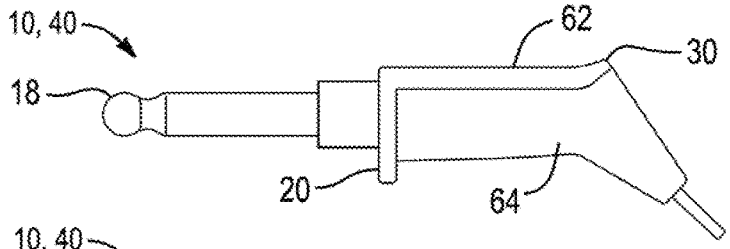
FIG. 19 illustrates a side view of a plug.

FIG. 19 a side view of a reusable 40 plug 10. The electrical plug 10 includes a single pin 18. The electrical plug also has a hilt 20 located on the bottom side 64 and a ridge 30 on the top side 62.

Figure 20:
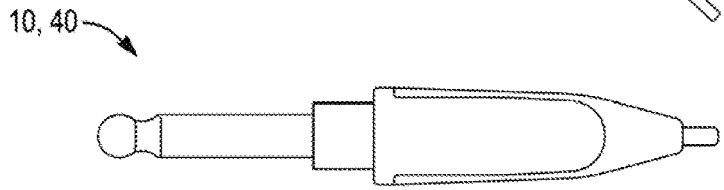
FIG. 20 illustrated a top view of the plug of FIG. 19.

FIG. 20 illustrates a top view of a plug 10 of FIG. 19 that is disposable 42.

Figure 21:
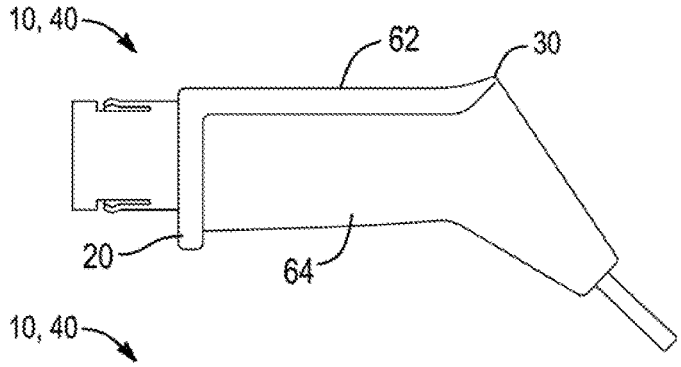
FIG. 21 illustrates a side view of a plug with a boss.

FIG. 21 illustrates a side view of a reusable 40 plug 10 with a hilt 20 on a bottom side 64 and a ridge 30 on a top side 62.

Figure 22:
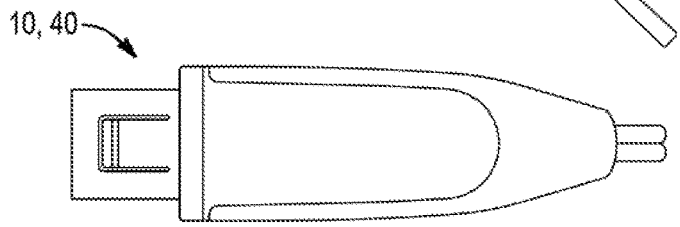
FIG. 22 illustrated a top view of the plug of FIG. 21.

FIG. 22 illustrates a top view of the reusable 40 plug 10 of FIG. 21.

Figure 23:
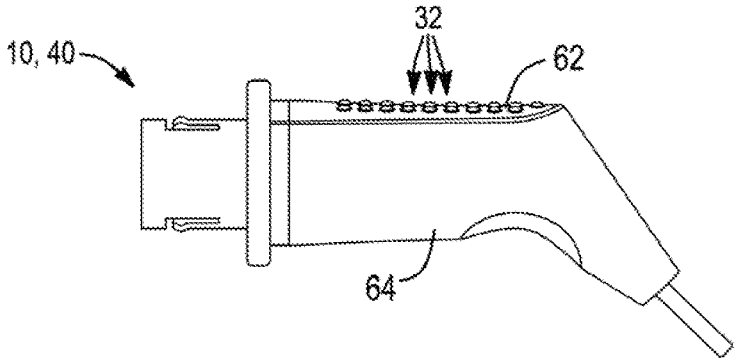
FIG. 23 illustrates a side view of a plug.

FIG. 23 illustrates a side view of a reusable 40 plug 10 with a radius 34 on the bottom side 64 and grips 32 on the top side 62.

Figure 24:
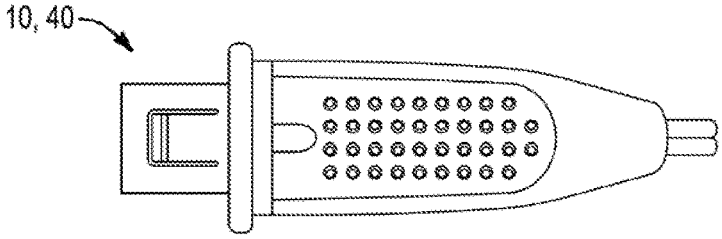
FIG. 24 illustrated a top view of the plug of FIG. 23.

FIG. 24 illustrates a top view of the reusable 40 plug 10 of FIG. 23.

Any numerical values recited herein include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The disclosures of all articles and references, including patent applications and publications, are incorporated by reference for all purposes. The term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of the elements, ingredients, components or steps. By use of the term "may" herein, it is intended that any described attributes that "may" be included are optional.

Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps.

It is understood that the above description is intended to be illustrative and not restrictive. Many embodiments as well as many applications besides the examples provided will be apparent to those of skill in the art upon reading the above description. The scope of the teachings should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. The omission in the following claims of any aspect of subject matter that is disclosed herein is not a disclaimer of such subject matter, nor should it be regarded that the inventors did not consider such subject matter to be part of the disclosed inventive subject matter.

2 Generator
4 Receptacle
6 Socket
10 Plug
12 Body portion
14 Boss
14A Flat Wall
14B Arcuate Wall
15 Insertion section
16 Collar
17 Through hole
18 Pin
19 Inner Bore
20 hilt
21A Flat wall
21B Arcuate Wall
22 lock
24 Insertion recess
26 Collar wall
30 ridge
32 grip
34 Radius
36 indicator
38 Attachment features
40 Reusable
42 Disposable
44 Longitudinal axis
46 Connection elements
50 Connection section
52 Longitudinal axis
54 Cord
60 Joint
62 Top of plug
64 Bottom or underside of plug
66 First side
68 Second side
70 adapter

We claim:

1. An electrical plug comprising: one or more connection elements;

a body portion housing the one or more connection elements and the body portion extending parallel to a longitudinal axis of the one or more connection elements;

a connection section connected to the body portion and extending from the body portion at an obtuse angle;

a radius located on the body portion, the connection section, a joint that connects the body portion and the connection section, or a combination thereof, wherein the radius is a sub-flush radius that is a finger relief located at a center of gravity of the plug; and a cord connected to an end of the connection section;

wherein the body portion and the connection section are connected at a joint and the joint includes the finger relief on an underside of the joint at the center of gravity of the plug, and wherein the plug comprises a boss with an outer bore having a D-shape, and an inner bore having a circular-shape, the circular-shaped inner bore is concentric with a curved portion of the D-shaped outer bore.

2. The electrical plug according to claim 1, wherein the one or more connection elements are one or more pins, one or more sockets, or both.

3. The electrical plug according to claim 2, wherein the connection section is angled and points downward relative to the longitudinal axis of the one or more connection elements when the one or more pins and the one or more sockets are aligned, and the one or more pins and the one or more sockets are aligned when the connection is pointing downward relative to the longitudinal axis of the one or more connection elements so that the one or more pins are extendable into the one or more sockets to form a connection.

4. The electrical plug according to claim 1, wherein the plug is balanced on the finger relief.

5. The electrical plug according to claim 1, wherein the plug comprises one or more grips that extend along a top of the body portion, and the radius is located on a bottom of the body portion that is opposite the top, wherein the one or more grips tactically indicate a top of the plug.

6. The electrical plug according to claim 5, wherein the one or more grips are circular-shaped.

7. The electrical plug according to claim 5, wherein the one or more grips are and arranged in straight lines, the straight lines are generally parallel to a longitudinal axis of the body portion.

8. An electrical plug comprising:

one or more connection elements;

a body portion housing the one or more connection elements and the body portion extending parallel to a longitudinal axis of the one or more connection elements, the body portion having:

a top side, a bottom side, a first side extending between and connecting the top side to the bottom side, and a second side extending between and connecting the top side to the bottom side;

a connection section connected to the body portion and extending from the body portion at an obtuse angle; and a cord connected to an end of the connection section;

wherein the body portion and the connection section are connected at a joint and the joint includes a thumb ridge, on the top side of the body portion, that is solid and stationary, wherein the body portion comprises a finger relief located at a center of gravity of the plug, and wherein the plug comprises a boss with an outer bore having a D-shape, and an inner bore having a circular-shape, the circular-shaped inner bore is concentric with a curved portion of the D-shaped outer bore.

9. The electrical plug according to claim 8, wherein the one or more connection elements are one or more pins, one or more sockets, or both.

10. The electrical plug according to claim 9, wherein the connection section is angled and points downward relative to the longitudinal axis of the one or more connection elements when the one or more pins and the one or more sockets are aligned so that the one or more pins are extendable into the one or more sockets to form a connection.

11. The electrical plug of claim 8, wherein the thumb ridge is a unitary part of the plug and the thumb ridge is made of the same material as the body portion.

12. The electrical plug according to claim 8, wherein the plug comprises one or more grips that extend along a top of the body portion, and the finger relief is located on a bottom of the body portion that is opposite the top, wherein the one or more grips tactically indicate a top of the plug, wherein the one or more grips are circular-shaped and arranged in straight lines, the straight lines are generally parallel to a longitudinal axis of the body portion.

13. An electrical plug comprising:

a body portion housing one or more connection elements;

a boss with:

an outer bore having a shape that is generally D-shaped, and an inner bore that is circular-shaped, the circular-shaped inner bore is concentric with a curved portion of the D-shaped outer bore, and wherein the one or more connection elements are located within the inner bore of the boss of the body portion, and wherein the plug is configured to extend into a receptacle of a generator and the boss of the plug and the receptacle are complementary in shape.

14. The electrical plug of claim 13, wherein the one or more connection elements are one or more pins, one or more sockets, or both, the connection elements are centered within the circular-shaped inner bore.

15. The electrical plug of claim 13, wherein the plug is configured to receive a portion of a generator so that the portion of the generator extends into the inner bore of the boss to form a connection.

16. The electrical plug of claim 13, wherein the boss extends beyond an end of the one or more connection elements.

17. The electrical plug of claim 13, wherein the plug includes a hilt that is generally D-shaped and a shape of the boss and the hilt are aligned.

18. The electrical plug of claim 13, wherein the boss is configured to extend into a receptacle of a generator and the boss is complementary in shape to the receptacle.

19. The electrical plug of claim 13, wherein a wall thickness between the inner bore and the outer bore varies.

* * * * *